United States Patent [19]

Wold

[11] Patent Number: 4,630,760

[45] Date of Patent: Dec. 23, 1986

[54] MAGNADRUM PUMP ASSEMBLY

[75] Inventor: Robert E. Wold, Troy, Mich.

[73] Assignee: Johnstone Pump Company, Troy, Mich.

[21] Appl. No.: 757,377

[22] Filed: Jul. 22, 1985

Related U.S. Application Data

[62] Division of Ser. No. 594,750, Mar. 29, 1984.

[51] Int. Cl.[4] ..... B67D 5/42

[52] U.S. Cl. ..... 222/387; 251/338

[58] Field of Search ..... 222/372, 375, 386, 389, 222/387, 326, 333, 261, 262, 404, 405, 146.2; 251/66, 72, 338, 336, 354

[56] References Cited

U.S. PATENT DOCUMENTS

| | | | |
|---|---|---|---|
| 665,013 | 1/1901 | Jones | 222/387 |
| 2,306,974 | 12/1942 | Oestermeyer et al. | 251/338 |
| 2,355,288 | 8/1944 | Fritzinger | 251/338 |
| 2,925,941 | 2/1960 | Bloxom | 222/389 |
| 3,982,669 | 9/1976 | Moore | 222/389 |

*Primary Examiner*—Joseph J. Rolla
*Assistant Examiner*—Kenneth Noland
*Attorney, Agent, or Firm*—Krass & Young

[57] ABSTRACT

A positive displacement pump type fluid dispensing system for viscous fluids in upright-open ended cylindrical containers. The system comprises a base adapted to receive and substantially center the container, a ram plate which is carried by a vertical elevator system to be thrust into the container to apply pressure to the fluid therein and a system of one or more air-operated positive displacement pumps which act through the ram plate to move fluid from the container. The ram plate is loosely mounted on the depending support structure so as to be displaceable relative to the support structure and the base and the container to accommodate axial misalignments. An edge seal having a cam surface on the edge of the ram plate assists in the alignment function and also provides a fluid pressure seal. Gravity operated valves are mounted on the ram plate to admit air to the container when the ram plate is withdrawn. An upper support assembly comprises a network of hollow beams which are integrated into the air inlet and exhaust system for the air motors to smooth out air pressure variations and to quiet the exhaust.

1 Claim, 6 Drawing Figures

MAGNADRUM PUMP ASSEMBLY

This application is a division of application Ser. No. 594,750, filed Mar. 29, 1984.

INTRODUCTION

This invention relates to dispensing systems of the type used to transfer viscous liquids from open-ended containers.

BACKGROUND OF THE INVENTION

Viscous liquids such as adhesives and sealants are typically shipped into factories and other industrial sites in cylindrical drums ranging in size and capacity from a few gallons to several hundred gallons. These containers are usually made of steel and have a lid which is removed when access to the viscous liquid is desired.

It is generally considered impractical to transfer viscous sealants and adhesives from their shipping containers into an intermediate container for dispensing; i.e., it is generally considered preferable to provide a dispensing system which is capable of cooperating with the original shipping container to remove and dispense the liquid directly therefrom. One type of container-compatible dispensing system comprises a base, a frame erected on the base for receiving therein an open-ended upright container of viscous material, a ram plate which is typically disc-like in configuration and adapted to enter into the open end of the container in close and conforming relationship to the walls of the container, and a vertically travelling elevator system which allows the ram plate to be raised and lowered relative to the container. A positive displacement pump is carried by the ram plate and has an intake portion, generally called a "shovel", depending from the bottom surface thereof so as to enter into the viscous liquid when in the operative arrangement. As the material is depleted from the container, the elevator system maintains a positive pressure on the fluid by gradually lowering the ram plate into the container.

Although prior art systems of the type described have been satisfactorily used, there are a number of areas in which difficulties can be encountered. These area include: maintaining proper alignment between RAM the plate and the container axis, maintaining an adequate seal between the edges of the ram plate and the sidewalls of the container, experiencing difficulty in withdrawing the ram plate from the container at the end of a dispensing operation and such other secondary problems as excessive noise from the cyclical operation of the power source for the positive displacement pump. These problems tend to magnify when larger containers are used.

Also by way of background, the preferred positive displacement pump for viscous fluids is the type disclosed in U.S. Pat. No. 3,995,966 wherein the vertical displacement rod of such pump is connected directly to the pump shovel and the disclosure of said U.S. Pat. No. 3,995,966 is incorporated herein by reference.

SUMMARY OF THE INVENTION

According to the present invention, a dispensing system for viscous liquid materials is provided which is capable of overcoming and, in fact, does overcome the problems and deficiencies of the prior art as set forth above.

In brief the invention resides in an apparatus for dispensing viscous liquids and comprising mechanical supports for positioning a ram plate such that it may be urged vertically into the open end of a cylindrical container to apply pressure to the liquid and to cause interaction between the liquid and the intake of a liquid flow channel which may, for example, include a positive displacement pump which depends from the bottom surface of the ram plate. In accordance with a first aspect of the invention, a floating support system for the ram plate is provided with means to permit limited lateral shifting of the ram plate relative to the support structure thereby to accomodate misalignments between the axis of ram plate movement and the center line or longitudinal axis of the container.

In accordance with a second aspect of the invention an improved peripheral edge seal for the ram plate is provided, such edge seal functioning not only to maintain pressure and prevent leakage around the edge of the ram plate as it is driven into the liquid material container but also to provide a camming function which assists in aligning the ram plate with the container axis upon initial entry.

In accordance with a third aspect of the invention, an improved relief valve arrangement in the ram plate is provided for the purpose of facilitating withdrawal of the ram plate from a partially or fully emptied container. In general, the improved relief valve comprises a simple gravity operated mechanical valve which is maintained in the closed position by contact with the upper surface of the material being pumped but which opens under the influence of gravity when the material is depleted thereby to admit air to the space between the ram plate and the material surface.

In accordance with a fourth aspect of the invention, an improved air supply and exhaust system is provided for the pneumatic pump motors which operate the positive displacement pump in the dispensing system. In general this aspect of the invention comprises the construction of an upper frame assembly for the mechanical support of the air motors and the ram plate and in which the beams are hollow and interconnected with the air supply and air motors such that one or more of the beams acts as an air inlet accumulator and one or more of the beams acts an exhaust chamber. This has been found to substantially improve the operation of the air motor and to reduce noise levels and is particularly advantageous where two or more pumps are mounted in a single ram plate.

Further features and advantages of the invention including the disclosure of an improved container and an improved container locating system will become apparent from a reading of the following specification which is to be taken with the accompanying drawing.

DESCRIPTION OF THE ILLUSTRATIVE EMBODIMENT

Figure 1:
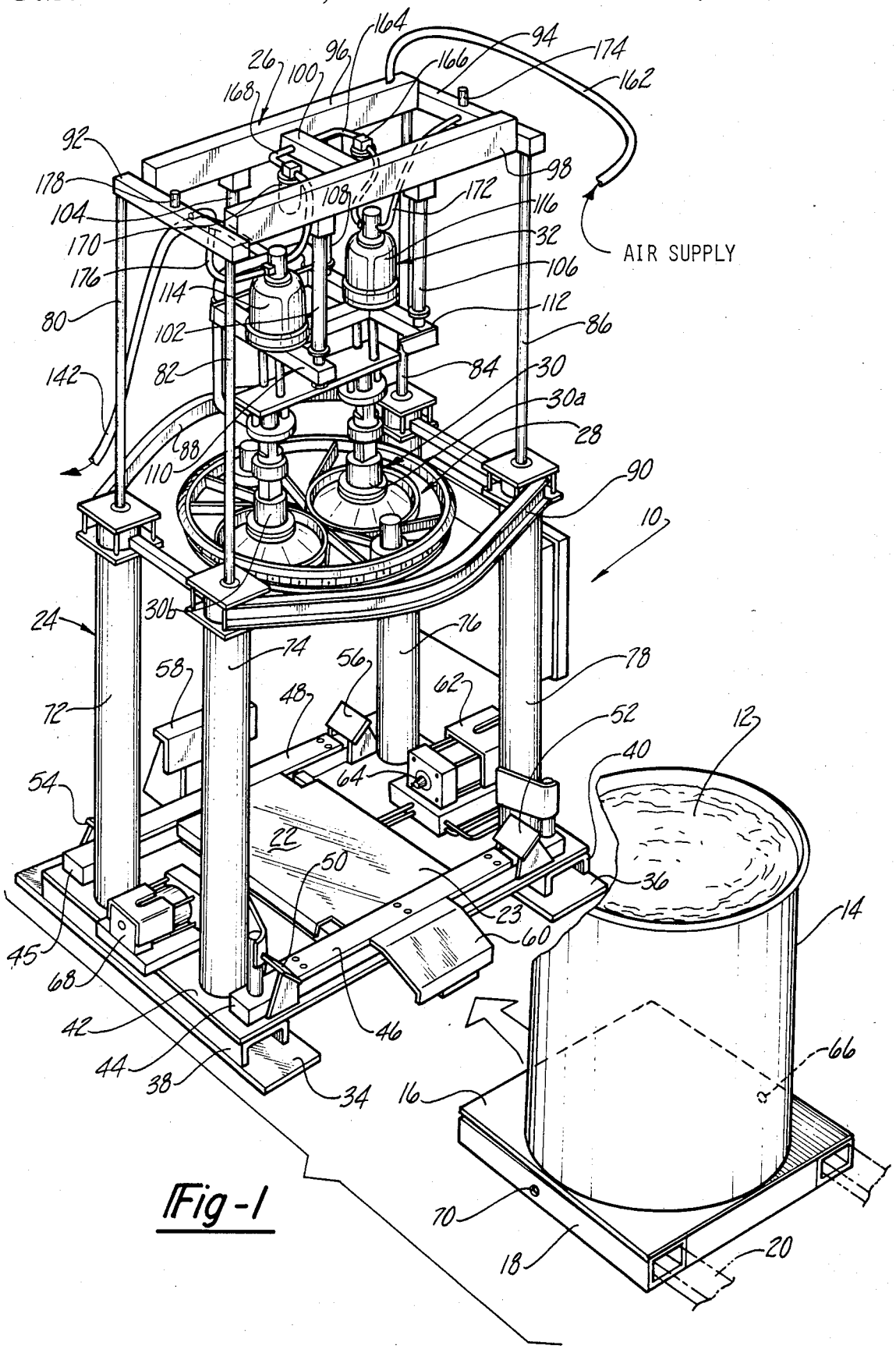
FIG. 1 is a perspective view of a double pump fluid dispensing system embodying the various aspects of the invention.

The illustrative embodiment of the invention comprises a dispensing apparatus 10 for removing a viscous liquid 12 such as a sealant or adhesive or sound deadening material or filler from an upright, open-ended, chineless, cylindrical steel container 14. The container 14 which is designed especially for the apparatus 10 includes an integral steel base plate 16 of square configuration in plane view. The plate 16 is welded to a series of box section beams 18, two of which have rectangular end openings to receive the lifting tangs 20 of a conventional fork lift truck. In the specific embodiment the container 14 is sized to hold approximately three hundred gallons of the liquid 12, is approximately five feet in vertical dimension by forty-three inches in diameter and has a smooth, straight sided cyclindrical interior, the diametral dimension of which is constant over its axial length and held to fairly close dimensional tolerances. The upper open end of the container 14 is flared slightly and configured to receive a lid, the details of which form no part of the present invention.

Apparatus 10, generally described, comprises a base section 22 adapted to receive the container 14 therein, a pneumatic elevator section 24 which carries and provides vertical translation of an upper frame assembly 26, a ram plate 28 which depends from the upper frame assembly 26, is adapted to enter into the container 14 and which is provided with positive displacement pumps 30 the reciprocating actions of which are powered by air motors 32.

As an overall description of operation, the container 14 is placed within the base section 22 such that the ram plate 28 enters into the open end of the container 14 and applies pressure to the upper surface of the liquid 12. Pumps 30 are operated by air motors 32 to actuate positive displacement shovel type pumps (FIG. 2) to withdraw the liquid 12 from the container 14 and direct it toward a dispensing gun (not shown) via outlet line 142. As liquid 12 is depleted from the container 14, elevator section 24 is continuously operated to lower the ram plate 28 farther into the container 14 to maintan pressure on the liquid 12 and to maintain the shovel or intake portions of the pumps 30 in operative association with the liquid 12.

Describing now the apparatus 10 in greater detail, the base section 22 comprises parallel and spaced apart foot plates 34 and 36. Disposed upon the plates 34 and 36 and welded thereto are C-section riser beams 38 and 40 providing stable supports for a square base plate 42. Rigid box beams 44 and 45 are is located on and welded to the base plate 42 substantially centrally thereof and extend across the front and back of the base section 22. Sill plates 46 and 48 of low friction, high density polyethylene are screwed to the tops of beams 44 and 45, respectively. Angled plates 50 and 52 are disposed on suitable support legs on opposite lateral sides of sill plate 46 to provide passive centering as the base 16, 18 of the container 14 is lowered into place on member 44 by the forklift truck operator. Similarly angled plates 54 and 56 are disposed on opposite lateral sides of the sill plate 48 to provide the centering function. A backstop 58 is provided to assist the forklift truck operator in arriving at the correct depth for the location of the container and container base and a ramp 60 is provided at the entrance side of the apparatus 10 to assist the operator in determining the appropriate vertical elevation.

Figure 3:
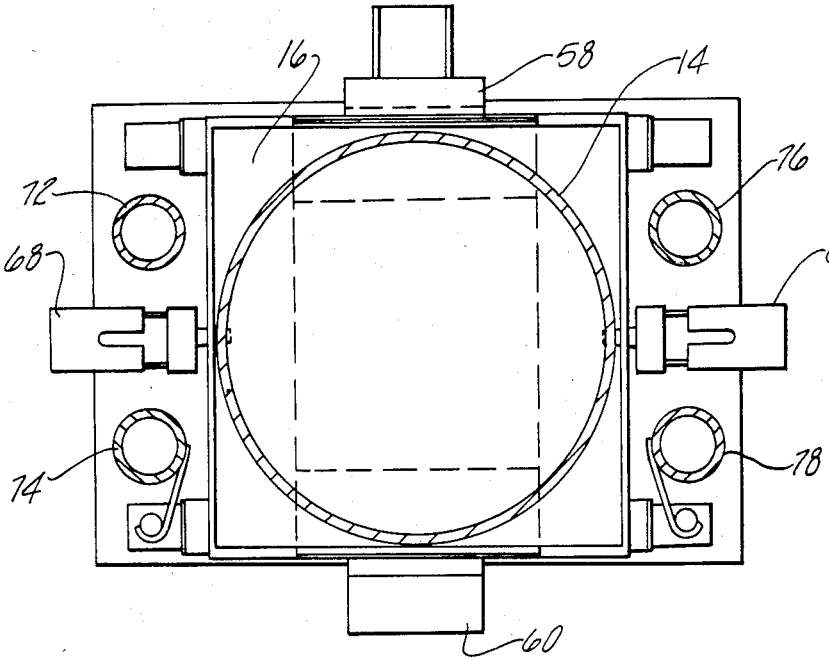
FIG. 3 is a plan view of the container centering system in the apparatus of FIG. 1.

On the right side of the base plate 42 as viewed in FIGS. 1 and 3 is a centering actuator 62 having actuated tapered pin 64 which, upon operation of the actuator 62 thrusts into a hole 66 precisely located in the right hand box beam of the container base as best shown in FIG. 1. A similar actuator 68 is located on the side of the base plate 42 as viewed in FIGS. 1 and 3 and has an identical tapered pin which can be thrust into the hole 70 in the box beam 18 as best seen in FIG. 1. The pin of the actuator 62 and 68, when thrust forwardly, precisely locate the container 14 on the base section 22 for further operations as hereinafter described.

Looking now to the elevator section 24, a set of long-travel pneumatic actuator cylinders 72, 74, 76 and 78 are located on the base plate 42 in a quadrangular pattern, just inside of the sill plates 46 and 48 and spaced apart laterally by a sufficient width to accommodate easy entry of the container 14 as previously described. The pneumatic cylinders 72, 74, 76 and 78 are parallel to one another and stand between 5 and 6 feet tall. Rods 80, 82, 84 and 86 extend from the pneumatic cylinders 72, 74, 76 and 78 respectively, the extent of extension being determined by parallel and simultaneous operation of the four actuators to raise and lower the upper frame assembly 26 as desired. Curved beams 88 and 90 are welded between the upper ends of cylinders 72, 76 and 74, 78 respectively to form a rigid assembly and also to limit the maximum height at which the container 14 may enter the base section 22. A non-load bearing plate 23 covers air inlet valves and supply lines for the cylinders 72, 74, 76 and 78.

The upper frame assembly 26 comprises a pair of hollow steel crossbeams 92 and 94, beam 92 being supported by rods 80 and 82 and beam 94 being supported by rods 84 and 86. Somewhat larger lateral crossbeams 96 and 98 are welded to and between the crossbeams 92 and 94 as best shown in FIG. 1 and a center beam 100 which is also hollow joins the beams 96 and 98 to provide continuous and intercommunicating sealed air chamber within the combination of the beams 96, 98 and 100 for purposes to be described.

Depending from the beams 96 and 98 for the support of the ram plate 28 the pumps 30 and the air motor 32 are hanger rods 102, 104, 106 and 108. Floating on the lower end of the hanger rods 102, 104, 106 and 108 is a rigid support frame made up of parallel fore-and-aft extending beams 110 and 112. In this specification, and with reference to the association between the beams 110, 112 and the hanger rods 102, 104, 106 and 108, the term "floating" refers to the fact that the frame consisting of beams 110 and 112 is purposely permitted fairly substantial movement, both laterally and vertically, relative to the hanger rods thereby to accommodate any misalignments between the vertical axis of travel of the ram plate 28 and the vertical center line of the container 14; i.e., even though the passive and active centering means of the base section 22 previously described provide a reasonably precise location of the container 14 within the apparatus 10, handling, aging and normal locational variations which are common to mechanical structures will ultimately produce an axial misalignment between the travel axis of the upper frame assembly 26 with the ram plate 28 depending therefrom and the vertical center line or axis of the container 14. Unless this misalignment is purposefully accommodated by the apparatus of FIG. 10, unnecessary strain and possible destruction of the components of the apparatus 10 may result. Details of the floating suspension are shown in FIG. 6.

Figure 2:
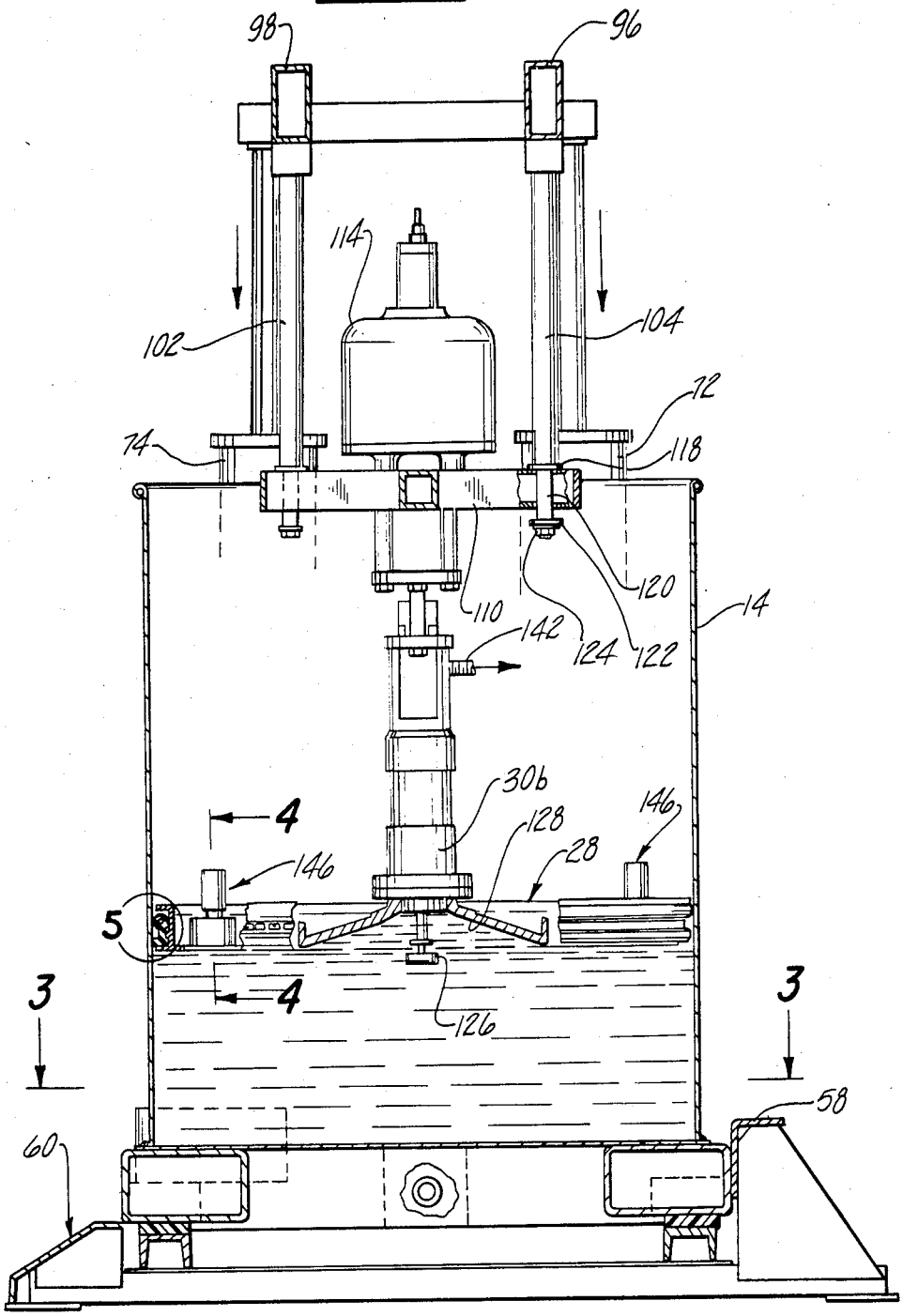
FIG. 2 is a side view of the apparatus of FIG. 1 partly in section with the ram plate substantially lowered into the open end of a straight sided container.
Figure 6:
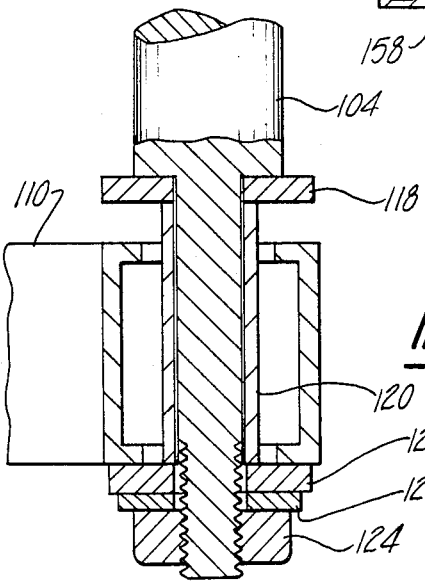

Looking in FIGS. 2 and 6 the details of the manner in which the loose or misalignment-correcting relationship is provided may be found. As shown in FIGS. 2 and 6 hanger rod 104, which is taken as typical of all four hanger rods, decreases to 1¼" diameter extension at the lower end and protrudes through thrust washer 118, spacer bushing 120, thrust washer 122 and is threaded at the lower end to receive a nut 124 and washer 125. The threaded end of the extension 104 or the nut 124 may be treated to provide a prevailing torque relationship between the nut and the extension to prevent accidental unwinding of the nut. Holes in the beam 110 of approximately 1⅞" diameter receive the 1½" extension 120 therethrough and thus provide approximately 3/16" of lateral movement capability of the entire frame comprising beams 110 and 112 relative to the overall combination of the base section 22, elevator section 24 and upper frame assembly 26. In addition, the axial length of the spacer bushing 120 is such as to permit about 1" of vertical play or travel between the beams 110, 112 and the hanger rods 102, 104, 106 and 108.

Returning now to the detailed description of apparatus 10 as shown in FIGS. 1 and 2, motors 114 and 116 are mounted on the frame made up of beams 110 and 112 and have vertically depending therefrom and laterally spaced apart in parallel orientation the positive displacement pump bodies 30*a* and 30*b*. The lower ends extend into and are mechanically integrated with the internally ribbed ram plate as best shown in FIG. 2. An axially extending shovel 126 projects from the lower end of the pumps 30*a* and 30*b* to pump fluid into the pump body and ultimately out through an outlet line 142. Although FIG. 2 suggests an air space or vertical gap between the top surface of the fluid 12 and the conical intake surface 128 of the ram plate 28, it is to be understood that pressure applied by the ram plate 28 to the fluid causes the fluid to flow upwardly into and fill this space, a fact of operation which will be understood by those skilled in the art.

Figure 5:
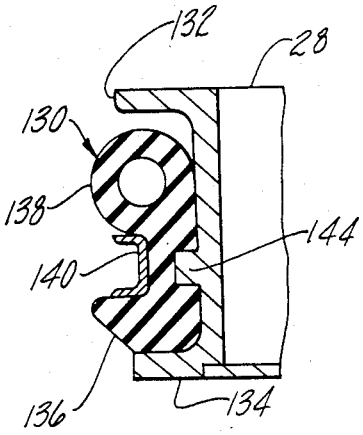
FIG. 5 is a side view in section of the ram plate edge seal and retainer elements; and, FIG. 6 is a sectional view of a detail of the floating support system.

Looking now to FIGS. 1, 2 and 5 the peripheral edge of the ram plate 28 must provide a seal to prevent a pressure loss and leakage of the fluid 12 from the container 14 as the ram plate is thrust into the container. For thi purpose and for an additional purpose hereinafter described, the edge of the plate 28 is fitted with a molded rubber edge seal 130 of special configuration. Ram plate 28 is flared outwardly at 132 and provided with a lower seat or flange 134 to receive and hold the edge seal 130 in place. Seal 130 is provided with a full lower section having a downwardly and inwardly cam surface 136 which cooperates with the upper lip flange of the container 14 upon entry to guide the ram plate 28 into proper alignment; i.e., it can be seen that the cam function of the surface 136 of edge seal 130 performs in cooperation with the loose fit between the flange plate support frame 110, 112 and the upper frame assembly 26 to provide proper and precise alignment between the motion axis of the ram plate 28 and the longitudinal axis of the container 14.

Edge seal 130 is further provided with a full and preferably hollow upper section 138 which seals with the inner surface of the container 14 to provide the principal pressure loss preventing function. Between fuller sections 136 and 138 the edge seal 130 exhibits a thinner section or beltline to receive an extrusion 140 as a retainer clamp by which the entire edge seal assembly is held in place. It will be appreciated that the edge seal 130 is extruded in strip form and is spliced and bonded to the proper diameter to circumscribe the peripheral edge of the ram plate 28 and further that the retainer clamp 140, permits the edge seal 130 to be conveniently and easily installed and replaced in the event of damage. The peripheral edge of the flange plate 28 may be provided with a locator bead 144 which fits into a slot or groove in the back of the edge seal 130 to provide precise alignment and fit.

Figure 4:
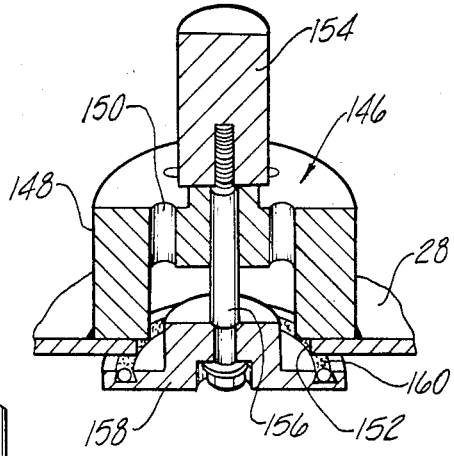
FIG. 4 is a perspective view in section of the ram plate relief valve.

Looking now to FIG. 4 a gravity operated valve 146 is shown mounted on the upper or exterior surface of the ram plate 28 for the purpose of automatically admitting air into the space between the inside or bottom surface of the ram plate and the top surface of the fluid 12 in the container 14 so that the ram plate can be withdrawn at the conclusion of a dispensing operation. The prior art alternative to the valve 146 at FIG. 4 involved the injection of air under pressure and to the aforementioned base, an operation which requires special fittings and also the availability of compressed air.

Valve 146, which may be provided in pairs as best shown in FIG. 2, comprises an annular aluminum body 148 which is molded or welded to the top surface of the flange plate 28, the valve body being provided with a plurality of spaced parallel openings 150 which communicate to a larger chamber within the valve body 148. As shown in FIG. 4 the valve body 148 is located over a hole 152 in the ram plate 28. A weight 154 is fastened to a rod 156 which extends through the valve body into the interior chamber and carries on the lower end thereof a stopper plate 158. The stopper plate is provided with an O-ring seal 160 which acts against the bottom of the ram plate 28 when the stopper plate 158 is forced by contact with the fluid 12 in the upward direction thereby to close the valve and prevent air from entering the container 14 through the holes 150. However, when the ram plate pressure is relieved by a backing away from the surface of the fluid, the force of gravity on weight 154 and on stopper plate 158 causes the stopper plate to fall away from the bottom of the ram plate 28 and opens the valves for the communication of air through ports or holes 150 into the interior of the container; i.e., beneath the pressure exerting surface of ram plate 28. Looking again to FIGS. 1 and 2 it can be seen that the apparatus contemplates the use of plural pumps 30*a* and 30*b* and plural air motors 114 and 116 for operating these pumps. In actual practice, the invention is not limited to any number of pumps and pump motors and is equally applicable to single pumps and single motor situations as well as to multiple pump and multiple motor applications. The use of the 300 gallon container 14, of course, favors the multiple pump and multiple motor arrangement but tends to increase the operating requirements for the compressed air supply and also tends to increase the noise which is produced by the pump motor operation in the area of the apparatus 10. To alleviate these problems, the air supply line 162 is connected into the hollow interior of the beams 96, 98 and 100 such that the total interior volume of these beams acts as an air pressure accumulator to minimize the instantaneous and transient pressure drops which are caused by the operation of the motors 32. A supply line 164 extends through a lubricator 166 to the motor 116 and a separate supply line 168 extends through a lubricator 170 to the motor 114. The crossbeam 100 serves as the mounting structure for the supply lines 164 and 168 as shown. Exhaust line 172 extends from motor 116 to the interior of beam 94 to act as a muffler or exhaust silencer and a small perforated difuser cylinder 174 is fitted into the beam 94 to vent the interior of the beam to the atmosphere. Motor 114 is similarly provided with an exhaust line 176 which is tied into the interior beam 92 and a difuser 178 vents the interior of the beam to the atmosphere.

It will be appreciated that the apparatus 10 provides a number of novel features not heretofore provided by similar systems, such features contributing together to promote the overall operating efficiency of the apparatus in dispensing viscous fluids from open ended upright containers. It will be appreciated that the features and the advantages of the apparatus 10 as described above are not limited to application to extremely large containers but may find equal advantage in substantially containers including those in the small gallon range. It is also to be noted that the apparatus may be used without pumps 30*a* and 30*b*, i.e., it is possible to apply sufficient pressure to the liquid via cylinders 72, 74, 76 and 78 to extrude it or force it to flow through the intake in plate 28 without the assistance of a positive displacement pump.

I claim:

1. A dispensing system for viscous materials comprising:

a ram plate for entry into the open end of a container for such material and having an opening therein;

an air driven pump motor having an air inlet circuit and an air exhaust circuit and having a positive displacement pick-up which operates through and in conjunction with the ram plate;

elevator means for raising and lowering the ram plate and the pump motor relative to the container;

a frame;

hanger means connecting the ram plate and air motor in depending relationship with the frame, said frame being supported by said elevator means above said container; and valve means mounted on said ram plate for automatically admitting air to the space between the ram plate and the material in said container as said ram plate is drawn away from said material, said valve means comprising:

(A) a cup shaped valve body mounted on said ram plate over said ram plate opening and having a top wall and an annular side wall coacting to define a central downwardly opening cavity communicating with and substantially coextensive with said opening;

(B) a central plunger passing through said top wall of said body and downwardly through said cavity and through said opening;

(C) a plate member secured to the lower end of said plunger below said opening;

(D) an annular valve seat defined on the upper surface of said plate member and sealingly coacting with the confronting undersurface of said ram plate around said ram plate opening;

(E) a weight secured to the upper end of said plunger above said top wall and normally resting on said top wall when said annular valve seat is spaced downwardly from said confronting undersurface of said ram plate thereby to open said valve means by gravity action; and (F) vent means in said body communicating between said cavity and atmosphere to allow the escape of air from the container, past said valve seat, and through said vent means.

* * * * *